United States Patent [19]

Gardner et al.

[11] Patent Number: 4,862,605

[45] Date of Patent: Sep. 5, 1989

[54] SUPER SOLE INNER-SOLE

[76] Inventors: Harris L. Gardner, 174 Riverside Ave., Cranston, R.I. 02910; Lance J. Reardon, 15328 Wheeler La., Sparks, Md. 21152

[21] Appl. No.: 245,229

[22] Filed: Sep. 16, 1988

[51] Int. Cl.[4] ..... A43B 13/38

[52] U.S. Cl. ..... 36/43; 36/88; 36/91

[58] Field of Search ..... 36/25 R, 28, 43, 88, 36/91, 92, 93, 114, 129

[56] References Cited

U.S. PATENT DOCUMENTS

| | | | |
|---|---|---|---|
| 1,477,825 | 12/1923 | Heitler | 36/91 |
| 1,669,987 | 5/1928 | Chapelle | 36/25 R |
| 4,070,770 | 1/1978 | Vello | 36/43 |
| 4,551,930 | 11/1985 | Graham | 36/114 |
| 4,561,195 | 12/1985 | Onoda | 36/28 |
| 4,620,376 | 11/1986 | Talarico | 36/114 |
| 4,654,983 | 4/1987 | Graham | 36/114 |
| 4,682,425 | 7/1987 | Simmons | 36/43 |

FOREIGN PATENT DOCUMENTS

| | | | |
|---|---|---|---|
| 1168440 | 6/1984 | Canada | 36/43 |
| 211283 | 2/1987 | European Pat. Off. | 36/25 R |

*Primary Examiner*—Werner H. Schroeder
*Assistant Examiner*—Diana L. Biefeld
*Attorney, Agent, or Firm*—Barlow & Barlow, Ltd.

[57] ABSTRACT

An inner-sole for footwear is constructed of resilient material with a heel portion thicker than the toe portion and a constant tapering angle from the outer lateral portion to the inner medial portion throughout and also a longitudinal slight angle from heel to toe.

1 Claim, 1 Drawing Sheet

14
12
6.
6

10
16
5
5
4
4
18
20
14
12
16
10
18
20

18
20

16
10

14
12

SUPER SOLE INNER-SOLE

BACKGROUND OF THE INVENTION

There have been many configurations of inner-soles for use in foot wear that have taken the form of simple arch supports to contoured inner-soles as seen in the Del Vecchio U.S. Pat. No. 4,084,333. There have also been some attempts at trying to shift the foot by raising the outer lateral portion and narrowing the medial portion as suggested by the Sharp U.S. Pat. No. 1,137,092 but these prior attempts have not been totally satisfactory since, in situations such as alluded to above, there has always been an arch structure which failed to completely allow rotation of the foot.

SUMMARY

The inner-sole is constructed of simple tapering shapes wherein the heel portion is higher than the toe portion and the outer lateral portion is higher than the inner medial portion. Essentially, the inner-sole has a flat bottom face with the upper face exhibiting the angles mentioned. The angle from heel to arch to toe is a continuous longitudinal taper.

DESCRIPTION OF THE PREFERRED EMBODIMENT

Figures 1, 2, 3, 4, 5, 6:
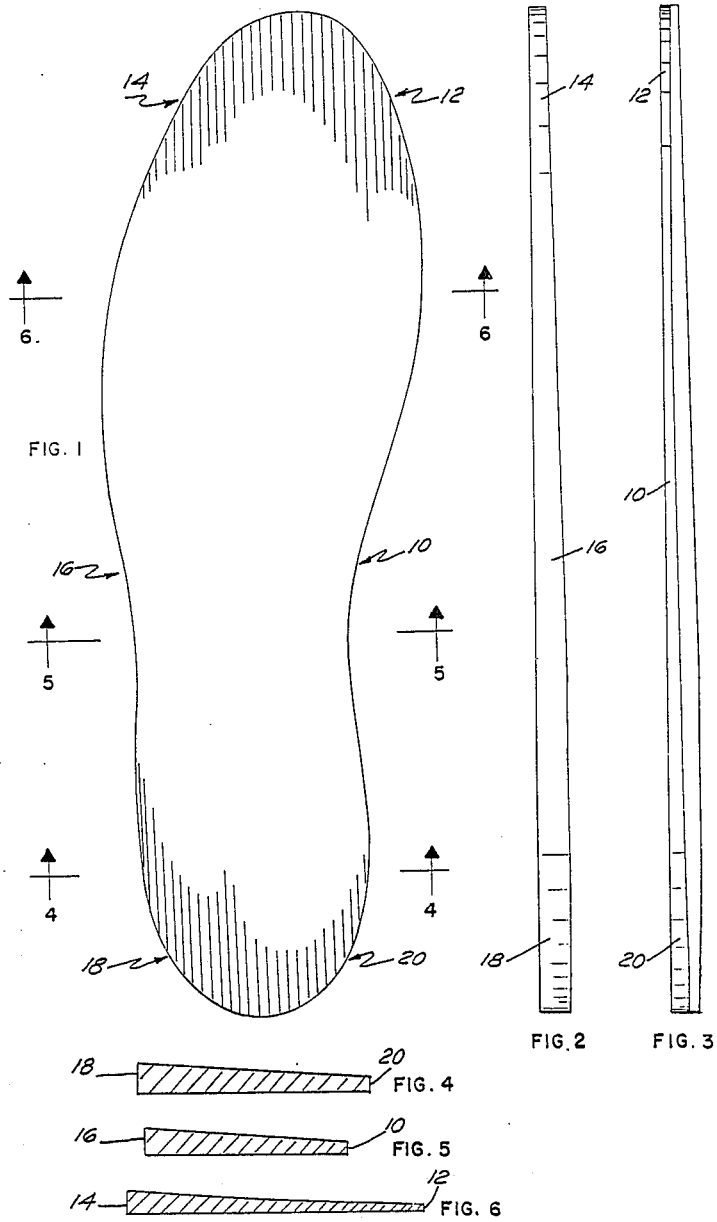
FIG. 1 is a plan view of the inner-sole of my invention showing a left foot.
FIG. 2 is a side elevational view taken from the left hand side of FIG. 1.
FIG. 3 is a side elevational view taken from the right hand side of FIG. 1.
FIG. 4 is a sectional view taken on lines 4—4 of FIG. 1.
FIG. 5 is a sectional view taken on lines 5—5 of FIG. 1.
FIG. 6 is a sectional view taken on lines 6—6 of FIG. 1.

Referring to the drawings a left foot inner-sole is shown by way of example which is intended to be used as a cushion in sole of a size to underlie the surface of a human foot. The construction shown also may apply to an outer sole as part of footwear. The inner-sole is made of a cushioning material such as a vinyl foam made from a liquid composition known as plastisol which forms a light weight structural foam. The inner-sole may be molded or cut from a sheet of material to the particular shape as seen in the drawings. Essentially, the inner-sole has a medial toe area 12 and a lateral toe area 14; the lateral area being thicker than the medial area. The inner-sole has an arch area 10 designating the medial arch and 16 the lateral arch. The thickness of the lateral arch 16 is greater than the medial arch thickness. Similarly, there is a heel area, 18 designating the lateral heel area which is thicker than the medial heel area 20.

As seen more particularly in FIG. 3 there is a longitudinal slope from just ahead of the arch area to the toe area there also being a slope from the heel area through the arch area looking at it from a longitudinal sense. Essentially therefore, since the inner-sole has a taper from the outside or the lateral area to the inside or medial area, this shifts the weight to the inside of the foot. Also, the inner-sole is thin in the toe area which gives freedom for accommodating the toes in footwear. In addition, the inner-sole is a deterrent to over rotation of the ankle in the lateral ankle retarding the movement beyond the point of stress. The above descriptive angles are also used in the making of an inner-sole for medical use as well.

By using the inner-sole described, tension is reduced on the peroneal tendons by the elevation of the lateral side of the foot. A similar result is achieved in the iliotibial band at the femoral condyle. Users have reported a reduction in pain in lateral "shin splints". For example, elevating the medial side of the foot reduces the tension in the posterior tibial tendon, and eases shin splints and it takes stress off the medial aspect of the knee.

It must be noted that the heel area is several degrees lower than the portion running from the heel area longitudinally to the toe area. This presents a condition whereby the calcaneum or heel bone will strike a more natural and uniform plane as the foot starts to pronate, thereby presenting a more stable function of the foot. This structure can be readily seen in FIGS. 2 and 3 of the drawings.

We claim:

1. An innersole for footwear comprising a resilient element having a contour which reproduces the profile of the foot, said element including a heel portion, an arch portion and a toe portion, the heel portion being thicker than the toe portion, the innersole having a substantially planar lower surface and an upper support surface, said upper surface having a surface parallel to the lower face from the heel portion to forward of the arch portion at the outer lateral portion and at the medial side the heel portion tapers in a direction away from the arch portion toward the lower surface, said upper surface having a constant tapering angle from just forward of the arch portion to the toe portion and having a constant tapering angle from the outer lateral portion to the inner medial portion throughout the heel portion, the arch portion and toe portion.

* * * * *